US005367712A

United States Patent [19]

Smith et al.

[11] Patent Number: 5,367,712

[45] Date of Patent: Nov. 29, 1994

[54] SYSTEM FOR CHANGING THE SHAPE OR FIT OF GLOVE

[75] Inventors: Christopher H. Smith, Ponte Verda Beach, Fla.; Claudia Kieserling, Munich, Germany

[73] Assignee: Alexander, Smith & Co., Fairfield, Conn.

[21] Appl. No.: 953,994

[22] Filed: Sep. 30, 1992

[51] Int. Cl.[5] ..... A41D 19/00; A41D 13/08

[52] U.S. Cl. ..... 2/162; 2/19; 2/161.1

[58] Field of Search ..... D2/162, 16, 20, 18, D2/19, 158, 159, 161.1; 24/904, 712.1, 712.5, 712.9, 713

[56] References Cited

U.S. PATENT DOCUMENTS

| | | | |
|---|---|---|---|
| Re. 28,036 | 6/1974 | Rosenbaum . | |
| 272,945 | 2/1883 | Chambers | 24/904 X |
| 459,160 | 9/1891 | Troxler, Jr. | 24/712.1 |
| 1,276,099 | 8/1918 | Morrell | 2/162 |
| 1,377,648 | 5/1921 | Whitaker . | |
| 1,456,580 | 5/1923 | Sullivan | 2/162 |
| 1,490,174 | 4/1924 | Kennedy . | |
| 1,624,696 | 4/1927 | Turner . | |
| 1,631,735 | 6/1927 | Kennedy et al. . | |
| 1,900,395 | 3/1933 | Gitt, II | 24/904 |
| 2,988,744 | 6/1961 | Stobbe . | |
| 3,504,379 | 4/1970 | Glick | 2/161.1 |
| 3,528,107 | 9/1970 | Rosenbaum . | |
| 3,588,917 | 6/1971 | Antonious . | |
| 3,918,097 | 11/1975 | Mlodoch . | |
| 4,042,977 | 8/1977 | Antonious . | |
| 4,065,813 | 1/1978 | Hudson . | |
| 4,168,063 | 9/1979 | Rowland . | |
| 4,281,647 | 8/1981 | Antypas . | |
| 4,471,495 | 9/1984 | Kruse et al. | 2/167 X |
| 4,519,097 | 5/1985 | Chappell, Jr. et al. . | |
| 4,541,126 | 9/1985 | Howard et al. . | |
| 4,658,445 | 4/1987 | Tribble . | |
| 4,700,405 | 10/1987 | Sternberg . | |
| 4,720,875 | 1/1988 | Latina et al. . | |
| 4,730,354 | 3/1988 | Saito . | |
| 4,796,306 | 1/1989 | Mitchell . | |
| 4,853,975 | 8/1989 | Clevenhagen . | |
| 4,884,300 | 12/1989 | Vistins . | |
| 4,937,882 | 7/1990 | Hayes . | |
| 5,042,177 | 8/1991 | Schoch . | |
| 5,075,899 | 12/1991 | Funahashi et al. . | |
| 5,113,530 | 5/1992 | Smith . | |
| 5,113,599 | 5/1992 | Cohen et al. . | |
| 5,117,567 | 6/1992 | Berger . | |
| 5,155,864 | 10/1992 | Walker et al. . | |
| 5,155,865 | 10/1992 | Walker et al. . | |
| 5,155,866 | 10/1992 | Walker et al. . | |
| 5,158,767 | 10/1992 | Cohen et al. . | |
| 5,184,815 | 2/1993 | Maddox . | |

FOREIGN PATENT DOCUMENTS

| | | | |
|---|---|---|---|
| 2638615 | 11/1988 | France . | |
| 34035 | 8/1905 | Switzerland | 24/712.1 |
| 4248 | 3/1893 | United Kingdom | 24/712.1 |
| 9009115 | 8/1990 | WIPO . | |
| 9208379 | 5/1992 | WIPO . | |
| 9211780 | 7/1992 | WIPO . | |
| 9311677 | 6/1993 | WIPO . | |

*Primary Examiner*—Clifford D. Crowder
*Assistant Examiner*—Larry D. Worrell, Jr.
*Attorney, Agent, or Firm*—Brumbaugh, Graves, Donohue & Raymond

[57] ABSTRACT

A glove is provided for enhancing the fit around a hand inserted therein. The glove has a fit adjusting mechanism attached to one or more adjusting strips via a adjusting cable element which has a variable effective length. The adjusting strip or strips extend substantially circumferentially around the base of the glove. As the adjusting mechanism is turned, the effective length of the cable element is shortened thereby cause the closed loop of the strip and cable element to contract around the hand inserted in the glove. As a result, the fit of the glove around the hand is enhanced.

44 Claims, 14 Drawing Sheets

SYSTEM FOR CHANGING THE SHAPE OR FIT OF GLOVE

BACKGROUND OF THE INVENTION

This invention relates to a system for improving the fit of a glove, specifically a sports or work glove, which generally serves to protect the hand inserted into it. More specifically, the system when used with a sports glove aids in retrieval and retention of a ball or the gripping or manipulation of a stick such as hockey or lacrosse stick. Notwithstanding the variety of gloves the present invention may be used with, the invention disclosed herein will by way of example be described in connection with a baseball glove or mitt.

In the game of baseball a ball must often be plucked from the air at speeds of up to 150 km/h. Due to these high speeds, a high kinetic energy acts upon the catching hand. For this reason, the glove must have a comparatively rigid design so as to provide sufficient resistance to distortion and various means of cushioning impact and securing a ball once it has entered the glove area.

Since the glove, most often industrially manufactured by using a certain size template, must fit many hand sizes and shapes, it is unusual for a glove to fit a specific hand correctly. For example, and in most instances, the glove is too big for the hand and hence the fit is undesirably loose. Adapting the glove for a good fit to the respective back of the hand, to the thenar and metacarpal areas as well as to the area of the wrist is often very difficult. Moreover, when there is too much space between the glove surfaces and the hand, irritation may easily occur during use, e.g. a baseball game, thereby diminishing catching precision. Even in a conventional glove, which is slightly spaced from the hand in certain areas, the gripping function is considerably impaired.

The present invention, therefore, has as its principal objective, the problem adjustment of a glove, specifically a sports glove, so as to provide a more precise, nearly customized fit of the glove to the individual shape of each hand in order to achieve unity between the hand and the glove. In other words the glove and the hand should quasi amalgamate into one unit, even though the glove, particularly the sports glove, is a mass-produced item.

SUMMARY OF THE INVENTION

In a first embodiment, the system comprises at least one fit-adjusting strip in association with a fit adjusting mechanism which can be operated, for example, by rotation. More specifically, the strip portion of the system is attached at least partially along the circumference on the outside of the glove. This first embodiment is particularly easy to produce, mostly as a result of its simple design.

In a second embodiment, at least one fit-adjusting strip is provided in association with a fit adjusting mechanism wherein the strip portion is attached at least partially along the circumference in the interior of the glove construction, for example, between at least two layers of the glove. This second embodiment presents the advantage that the adjusting strip or strips are less exposed to influences from the outside, due to their interior location and hence do not interfere with the proper function of the glove, such as a baseball glove.

In both embodiments the use of a rotational fit-adjusting mechanism for customizing the fit of the glove to the hand and/or for improving the fit of the glove to the surface of the hand, most preferably the back of the hand, is a preferred embodiment, since a dialing action is an easy means for actuating the adjusting mechanism.

The location of the adjusting strip or strips, either on the outside or within the glove interior, provide a nearly customized fit for the shape of the hand of the wearer, which for an athlete is generally important. For this reason, upon operation of the adjusting mechanism, the glove generally conforms more to the shape of the respective hand without creating undue pressure in the area of the back of the hand, which, if otherwise, could restrict the movement of the hand and glove. In accordance with the present invention, the glove which can be a mass-produced, will in association with the fit-adjusting system, provide the ability to give a nearly customized fit for the user.

In a particular preferred embodiment, the fit-adjusting mechanism is mounted on a structural support member or carrier. This provides secure support for the adjusting mechanism and maximum comfort between the glove and the hand. Moreover, when the carrier is pre-shaped to conform generally to the back of the hand, the forces which are created by activating the fit-adjusting device are uniformly distributed across the surface of the hand. Accordingly, there are no forces which concentrate on any single point on the hand when tightening the fit-adjusting device.

A further advantage of the present invention resides in the aspect that the fit-adjusting mechanism is located on the top side of the glove or on one side of the glove, particularly in the area of the metacarpal bones of the hand when inserted into the glove. In this manner the fit-adjusting device is kept away from the actual gripping movement of the hand which eliminates any possible restraints on the manipulation of the glove.

Accordingly, the design of the fit-adjusting system in its entirety combines ease of operation to achieve an optimum support of the glove on the respective hand and improved fit of the glove on the hand.

DESCRIPTION OF THE PREFERRED EMBODIMENTS

Figure 1A:
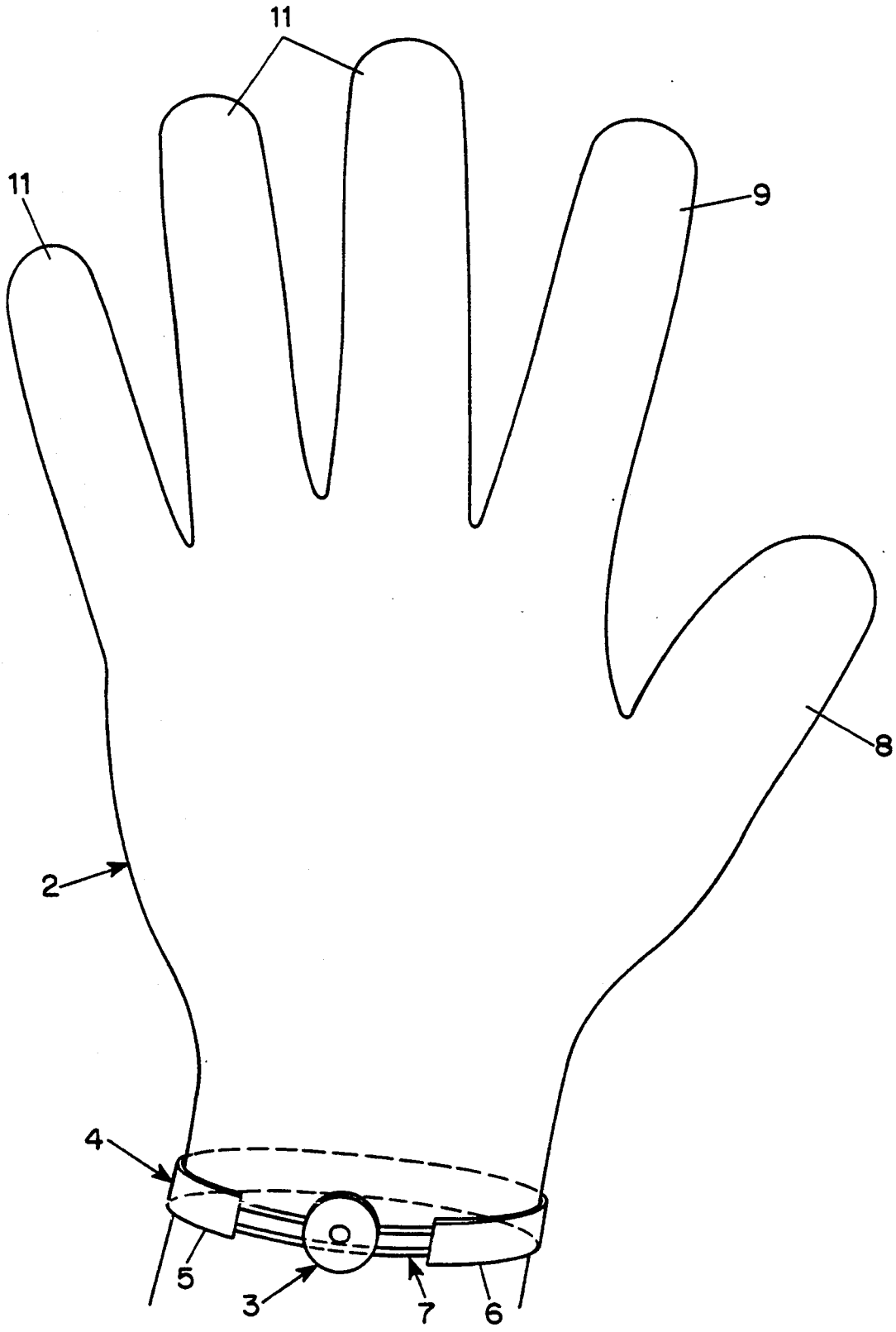
FIG. 1*a* is a schematic backside view of a preferred embodiment of the glove having a single adjusting strip.

FIG. 1 is an illustration of a rudimentary embodiment of the present invention. FIG. 1 depicts a glove 2 having a thumb sleeve 8 and four finger sleeves including an index finger sleeve 9 and three additional finger sleeves 11 into which a hand (not shown) is inserted. The invention is also effective with a mitt having less than four finger sleeves such as the first baseman's or catcher's mitts used in baseball. The glove 2 may also be a hockey glove, lacrosse glove, work glove or any other type of glove in which it is desirable to have an adjustable mechanism for customizing the fit of the glove to the hand. The glove 2 can be constructed, at least partially, of a material yielding to tensile stress such as leather, imitation leather, fiber material and/or trimmings made thereof.

At the base or wrist portion of the glove 2 on the backside portion, i.e., where the back of the hand abuts the glove but facing outward, is a fit adjusting mechanism 3 which controls the tightening and releasing of the glove 2 around the hand. The adjusting mechanism 3 in this embodiment is similar to the rotary closure described in U.S. Pat. No. 5,042,177 to Schoch (hereinafter "the '177 patent"), the disclosure of which is herein incorporated by reference.

An adjusting strip 4 made of leather or other partially elastic material extends substantially circumferentially around the base of the glove 2. The strip 4 runs from the backside of the glove 2 across the palm side of the glove, back to the backside of the glove. In this embodiment, the strip 4 is external to the glove 2. However, strip 4 can also be at least substantially, if not completely, located inside the glove 2 when the glove has two or more layers such as in the typical construction of a baseball glove. The adjusting strip 4 has two ends 5 and 6, each of which is connected to adjusting cable element 7. The adjustable cable element 7 can be, among other materials, a nylon lace, lanyard, steel wire, elastic material or any combination thereof.

Figure 1B:
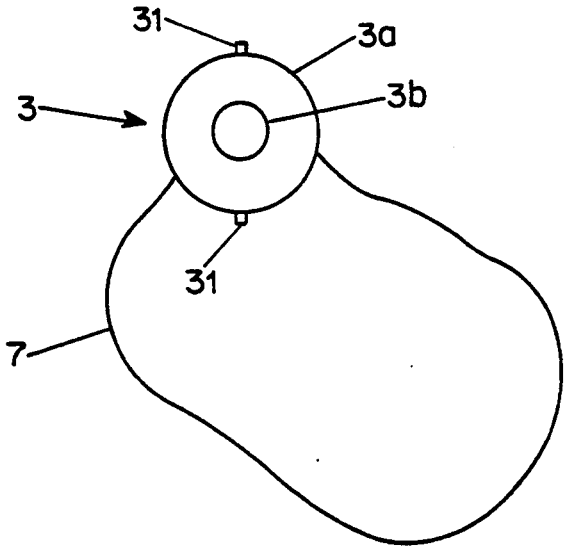
FIG. 1*b* is a top view of the fit adjusting mechanism and adjusting cable element.
Figure 1C:
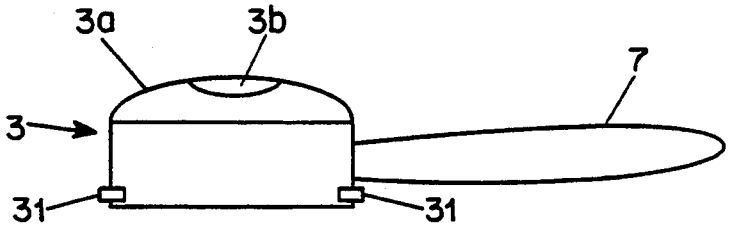
FIG. 1*c* is a side view of the fit adjusting mechanism and adjusting cable element.

The adjusting cable element 7 in this embodiment connects at one end to the adjusting mechanism 3 and at a first intermediate position attaches to one end 5 of the adjusting strip 4. The adjusting cable element 7 is attached at a second intermediate position to the other end 6 of the adjusting strip 4 and at the element's other end connects again to the adjusting mechanism 3. The effective length of the adjusting cable element 7 is changed by the operation of the adjusting mechanism 3 described in detail in the '177 patent which description is incorporated by reference herein. In short, as a knob 3*a* on the adjusting mechanism 3 shown in FIGS. 1*b* and 1*c* is turned in the clockwise direction, the effective length of the cable 7 is shortened as the end of the cable is wound onto a reel (not shown) of the adjusting mechanism 3 having a pawl mechanism (not shown). The effective length of the cable 7 is increased by either turning the knob of the adjusting mechanism 3 in the counterclockwise direction, which provides a controlled increase in the effective length of the cable 7 or by pushing a release button 3*b* on the adjusting mechanism 3 which provides a quick release for unlocking the cable 7 and allowing for substantial immediate increase in the effective length of the cable 7. In effect, the quick release decouples the pawl in the adjusting mechanism 3 thereby allowing the cable 7 to unwind from the reel to its maximum length.

Figure 1D:
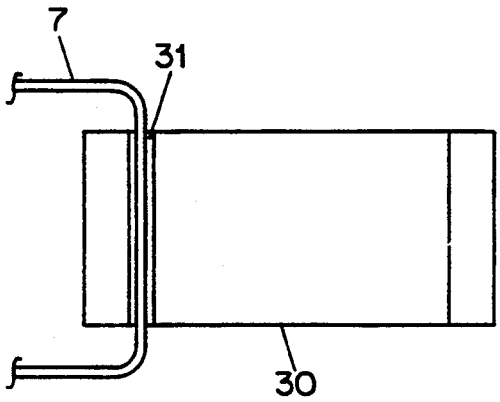
FIG. 1*d* is a top view of the tab for connections to the adjusting strip.
Figure 1E:
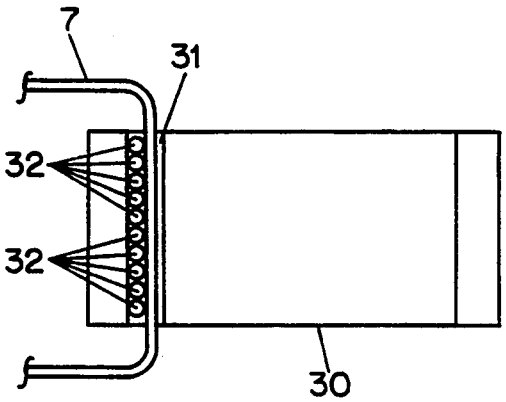
FIG. 1*e* is a top view of the tab for connections with antifriction elements.

As shown in FIG. 1*d*, after the cable element 7 exits the adjusting mechanism 3, it attaches to the adjusting strip 4 via a tab 30 with one end having a channel 31 through which the cable element passes. Tab 30 is generally constructed of hard, inelastic material or plastic. Tab 30 can also be constructed of leather. In order to decrease friction in the channel 31, antifriction elements 32 may be included in the channel 31 as shown in FIG. 1*e*. For example, ball bearings can be utilized. The other end of the tab 30 is permanently attached to the adjusting strip 4. The attachment can be accomplished by stitching or clamping, etc.

Because the adjusting strip 4 is attached at both ends 5 and 6 to the cable 7, a closed loop is thereby created around the base of the glove 2. As the effective length of the cable 7 decreases, the effective length of the closed loop around the base of the glove 2 decreases resulting in a tightening of the glove 2 around the hand inserted therein. As the effective length of the cable 7 is increased by either quick or controlled release, the effective length of the closed loop around the base of the glove 2 increases thereby loosening the fit of the glove 2 to the hand.

Figure 2:
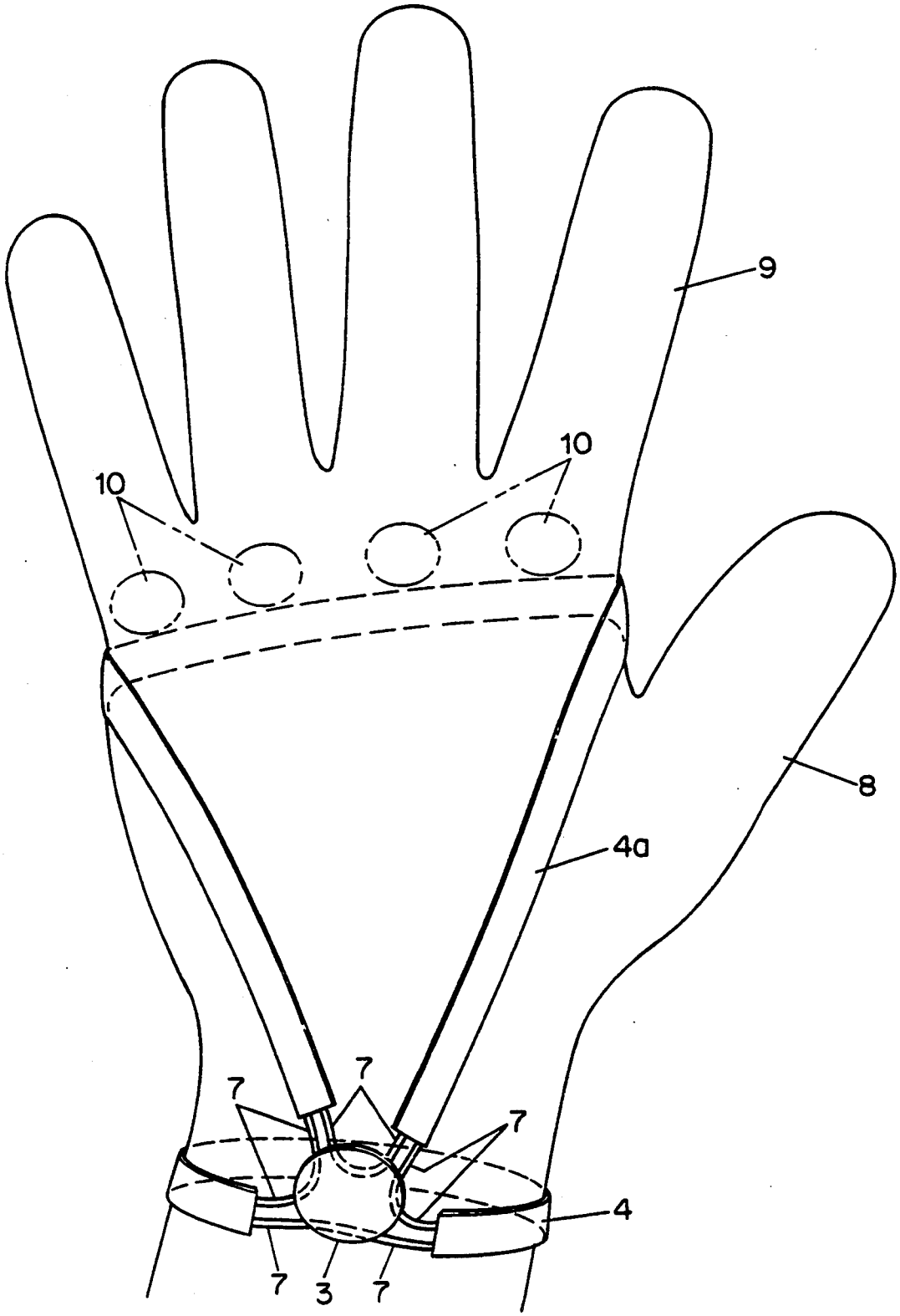
FIG. 2 is a schematic backside view of another preferred embodiment of the glove having multiple adjusting strips.

A second preferred embodiment is depicted in FIG. 2 wherein a second adjusting strip 4*a* extends from the adjusting mechanism 3 up between the base of the thumb sleeve 8 and the index finger sleeve 9 in the area of the metacarpal bones, across the palm side of the glove substantially in parallel to the finger joints 10, then around to the backside of the glove 2 and back to the adjusting mechanism 3. The adjusting strip 4*a* is attached to mechanism 3 via the cable 7 whereby third and fourth intermediate points of the cable 7 are each attached to a respective end of strip 4*a*. In the alternative, an additional adjusting element, similar to cable 7, can be connected to the strip 4*a*. In either event, as the knob (not shown) on mechanism 3 is turned clockwise, the effective length of the cable(s) 7 is shortened thereby decreasing the effective length of the closed loop between the thumb sleeve 8 and index finger sleeve 9 and across the palm side of the glove in addition to decreasing the closed loop which includes the first strip 4 around the base of the glove 2.

Figure 3:
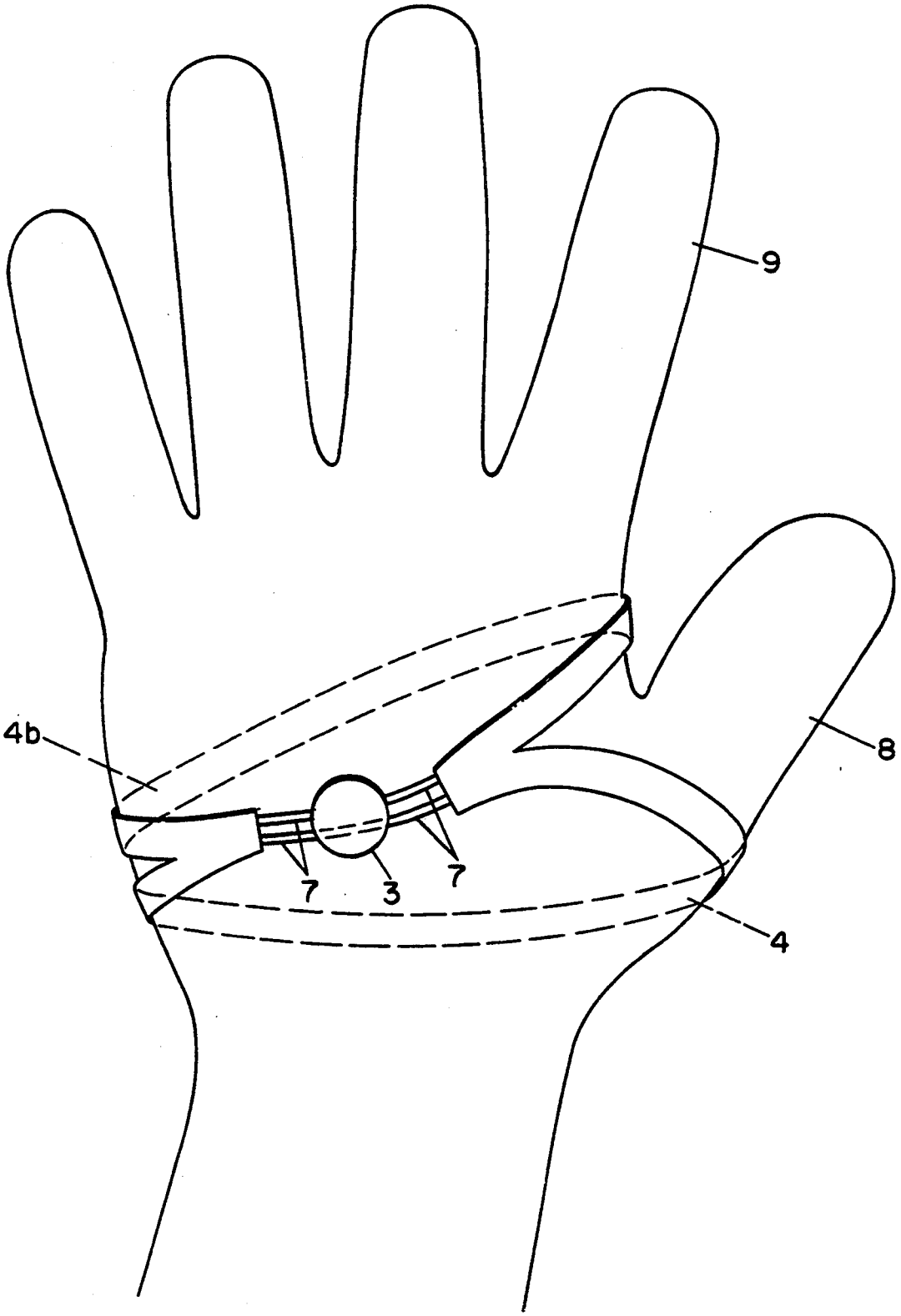
FIG. 3 is a schematic backside view of another preferred embodiment of the glove showing a first alternative alignment of the adjusting strips.

Rather than having the strip 4*a* substantially parallel to the finger joints (10), strip 4*a* can be replaced by a strip 4*b* which extends obliquely down between the thumb sleeve 8 and index finger sleeve 9 toward the base of the glove 2 for connection to adjusting mechanism 3 via cable 7 as depicted in FIG. 3. Also depicted in FIG. 3 is an alternative means for connecting two or more adjusting strips, i.e., 4 and 4*b*, via cable 7 whereby the two strips are joined at the ends. Accordingly, cable 7 attaches to the joined ends of strips 4 and 4*b* rather than attaching to each strip separately as depicted in FIG. 2.

Figure 4A:
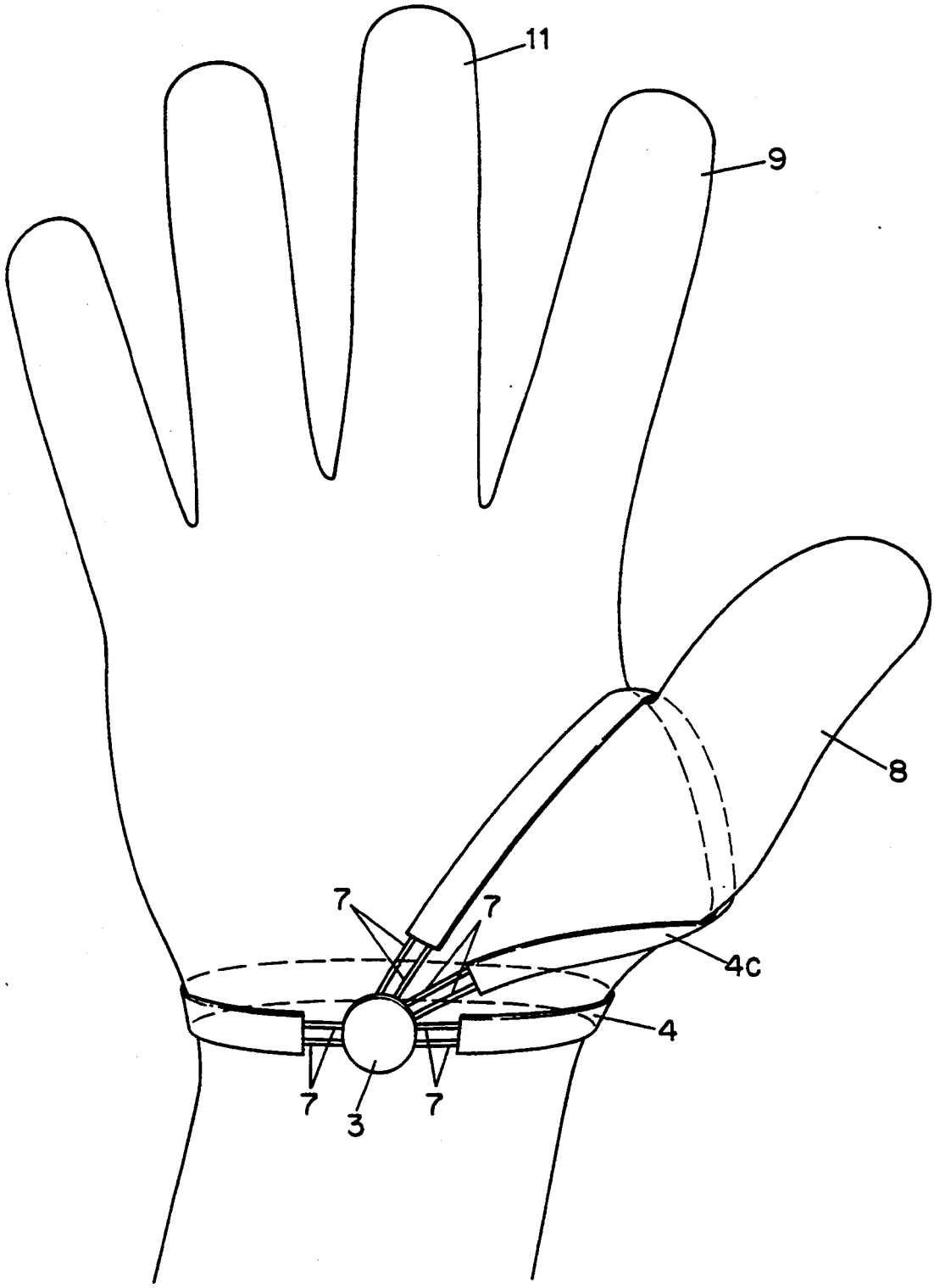
FIG. 4*a* is a schematic backside view of another preferred embodiment of the glove showing a second alternative alignment of the adjusting strips.
Figure 4B:
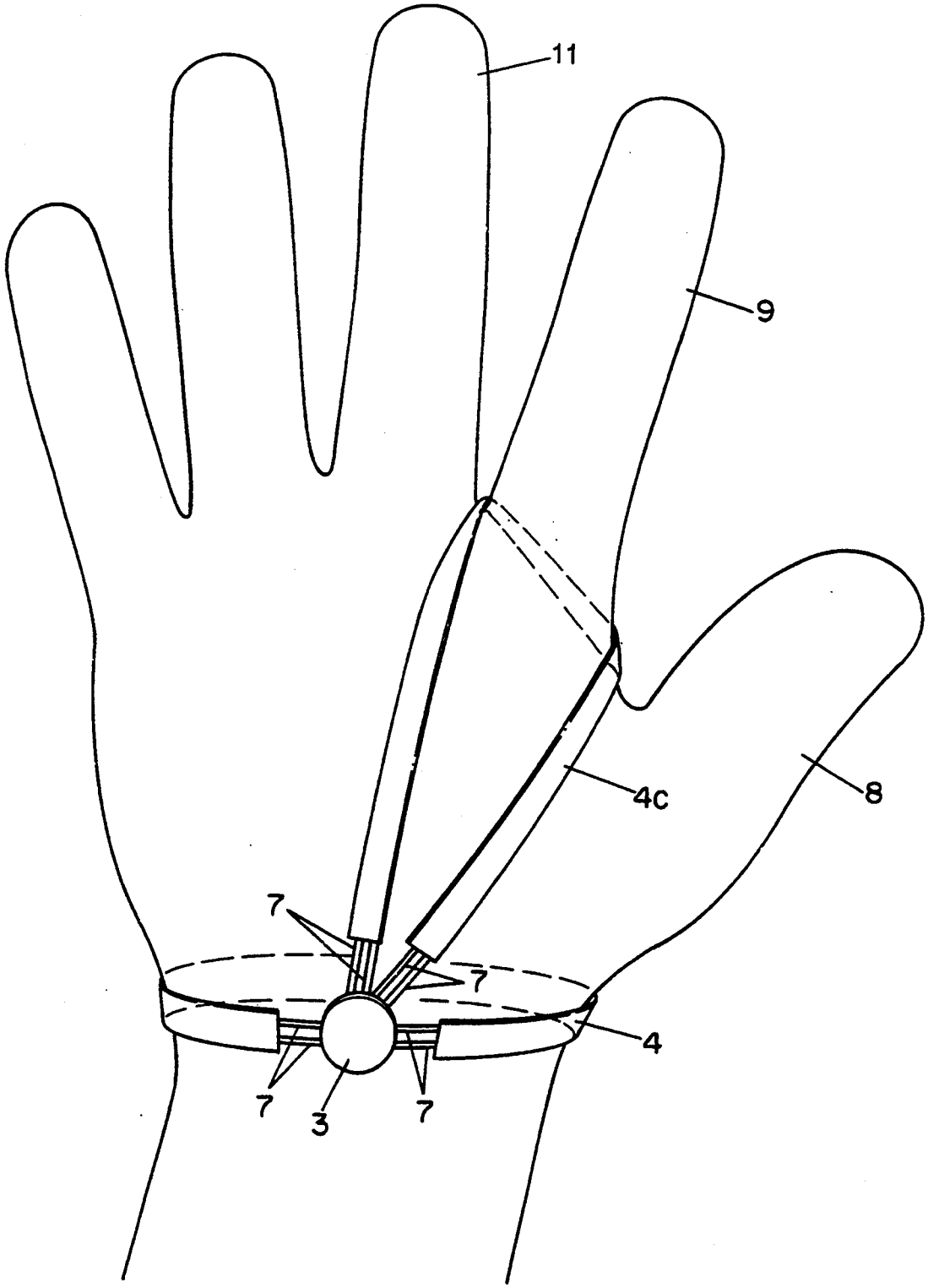
FIG. 4*b* is a schematic backside view of another preferred embodiment of the glove showing a third alternative alignment of the adjusting strips.

FIGS. 4*a* and 4*b* depict additional embodiments in which adjusting strips can be connected to the adjusting mechanism 3. For example, in FIG. 4*a*, strip 4*c* extends from the mechanism 3 via cable 7, around the thumb sleeve 8 and back to mechanism 3 via cable 7. FIG. 4*b* again depicts a further alternative arrangement wherein strip 4*c* is connected at both ends to mechanism 3 via the cable 7; however the strip 4*c* extends up to and around the index finger sleeve 9.

Figure 5:
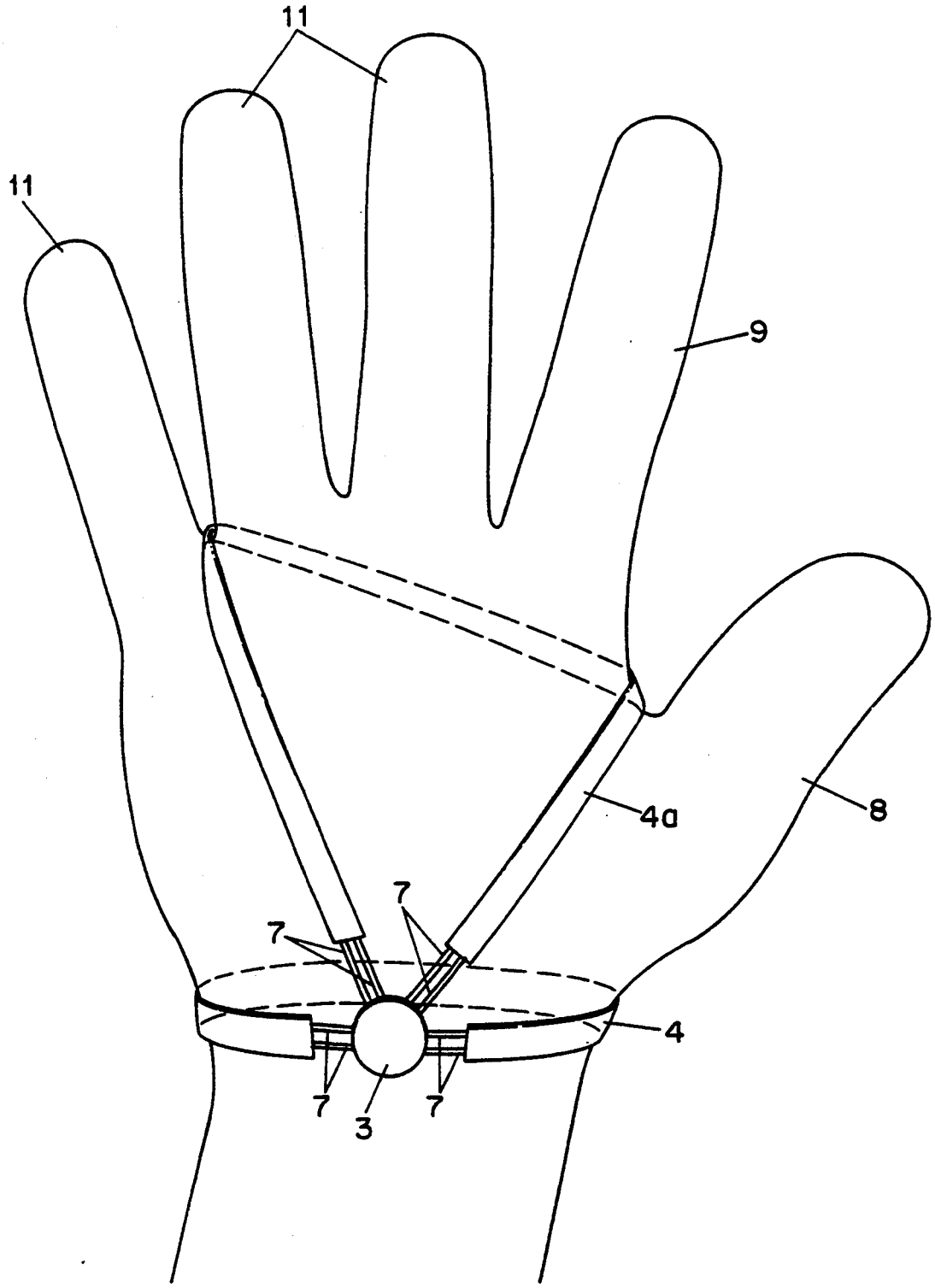
FIG. 5 is a schematic backside view of another preferred embodiment of the glove showing a fourth alternative alignment of the adjusting strips.
Figure 6A:
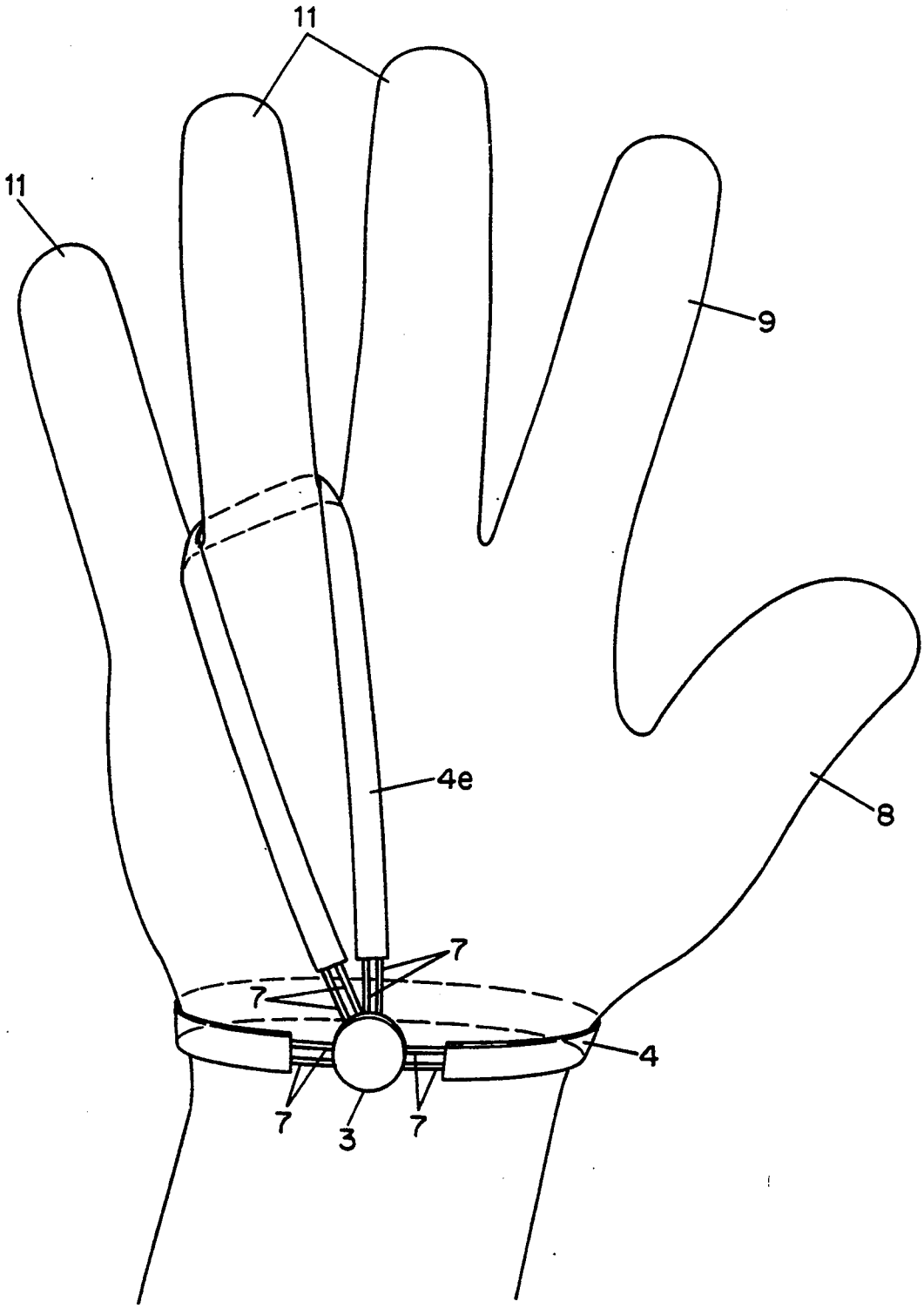
FIG. 6*a* is a schematic backside view of another preferred embodiment of the glove showing a fifth alternative alignment of the adjusting strips.

FIG. 5 illustrates the use of a second adjusting strip 4*a* of FIG. 2 which rather than extending across all four finger sleeves as in FIG. 2 extends across only three finger sleeves. FIG. 6*a* depicts an arrangement of the adjusting strip 4*e* connected at either end via cable 7 to adjusting mechanism 3 extending around one of the three additional finger sleeves 11.

In this embodiment the strip 4*e* can extend around any one or more of the additional finger sleeves 11. Although not shown in the drawings, any of the adjusting strips described herein can be combined with one or more of the other adjusting strips. A closed loop containing an adjusting mechanism 3, cable 7 and one or more adjusting strips (i.e., 4 or 4*a*, etc.) can be installed anywhere throughout the glove, where an improved fit between the glove and hand is desired. Moreover, more than one closed loop can be installed in the glove if desired. In other words, one glove 2 could have two or more adjusting mechanisms 3, each working independently with its own cable 7 and adjusting strip(s) 4.

Figure 6B:
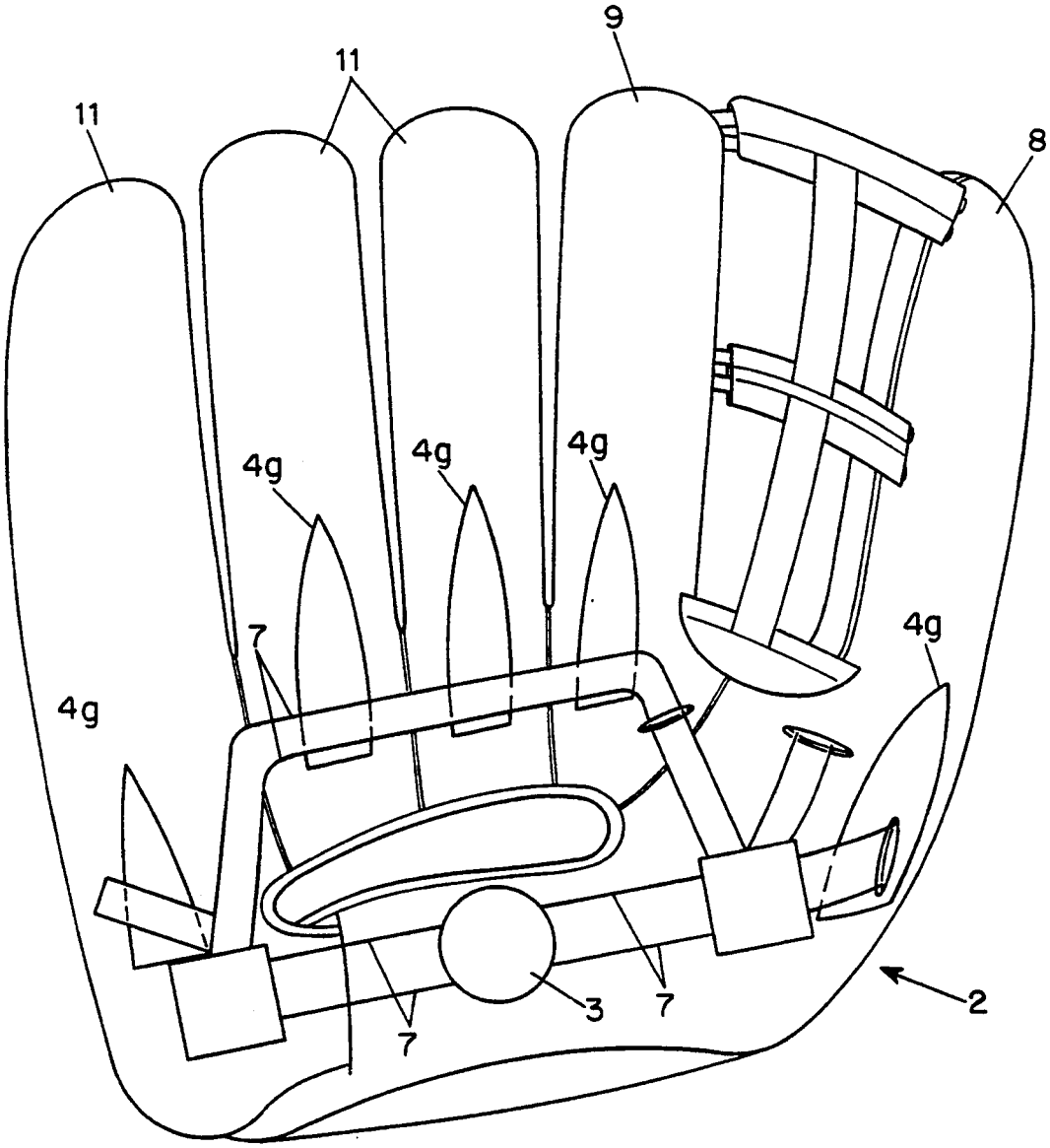
FIG. 6*b* is a schematic backside view of a glove with finger sleeve adjustment strips.

FIG. 6*b* depicts a glove 2 having additional strips 4*g* for improving the fit in each individual finger sleeve 9 and 11 and thumb sleeve 8. Any combination of finger sleeves can be made adjustable.

Figure 7A:
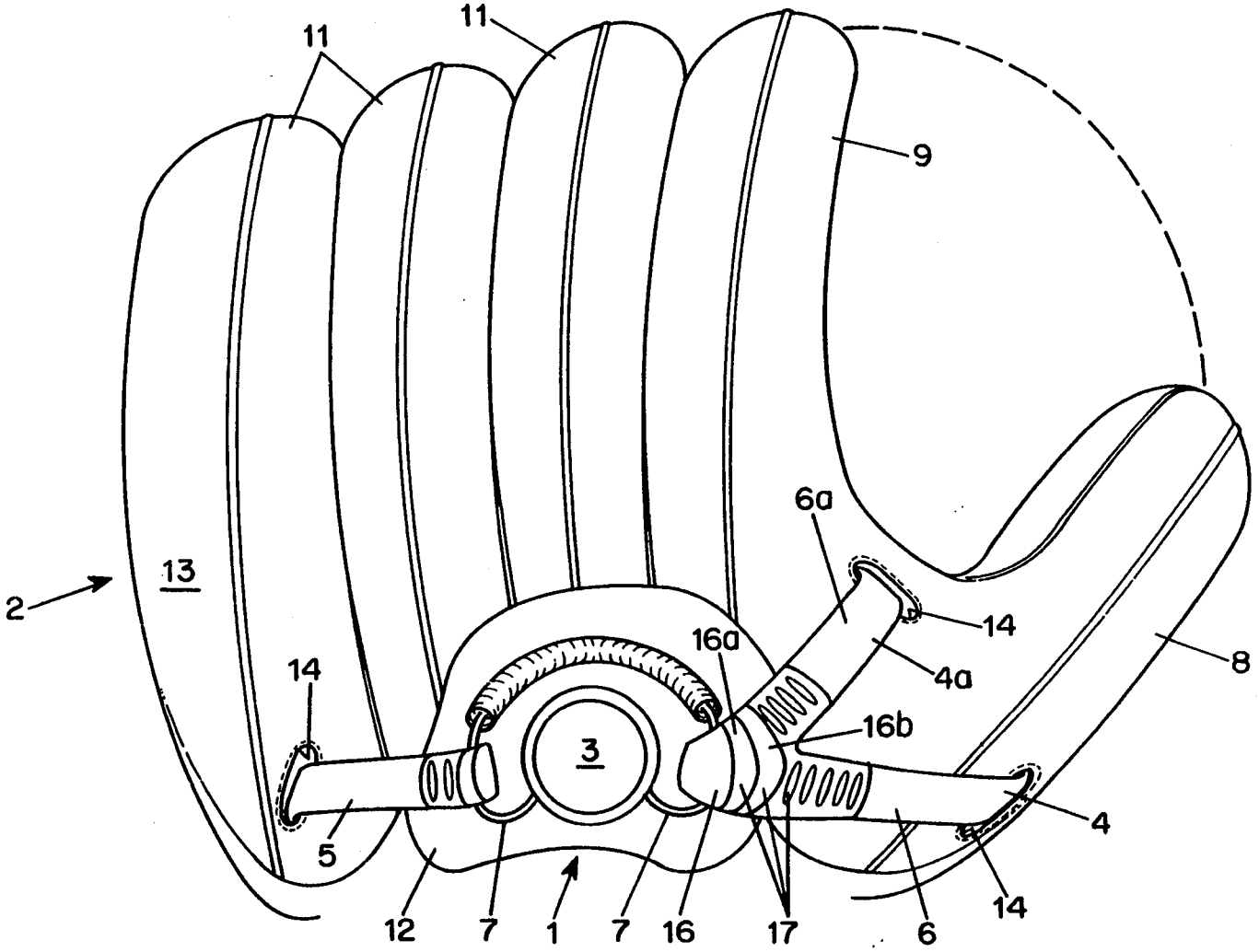
FIG. 7*a* is a schematic backside view of another preferred embodiment of the glove as applied to a baseball glove.

FIG. 7*a* depicts another preferred embodiment of the invention. FIG. 7*a* specifically shows the application of the invention to a baseball glove. However, each additional element described in conjunction with FIG. 7*a* could also be included in each of the embodiments discussed herein above.

In FIG. 7*a*, the adjusting mechanism 3 is attached to a support or carrier element 12 located at the backside 13 of the glove 2 near the base (i.e., near the wrist) of the glove 2. Carrier 12 (shown in greater detail in FIGS. 7*c* and 7*d*) is designed to conform at least in part to the shape of the adjusting mechanism 3 and extends generally along the backside of the base of the glove 2. Carrier 12 is formed with a cavity 12*a* into which the adjusting mechanism is seated and locked into position by locking tabs 31 and corresponding slots 34 shown in FIGS. 1*b* and 1*c* and FIGS. 7*c* and 7*d*.

Figure 7B:
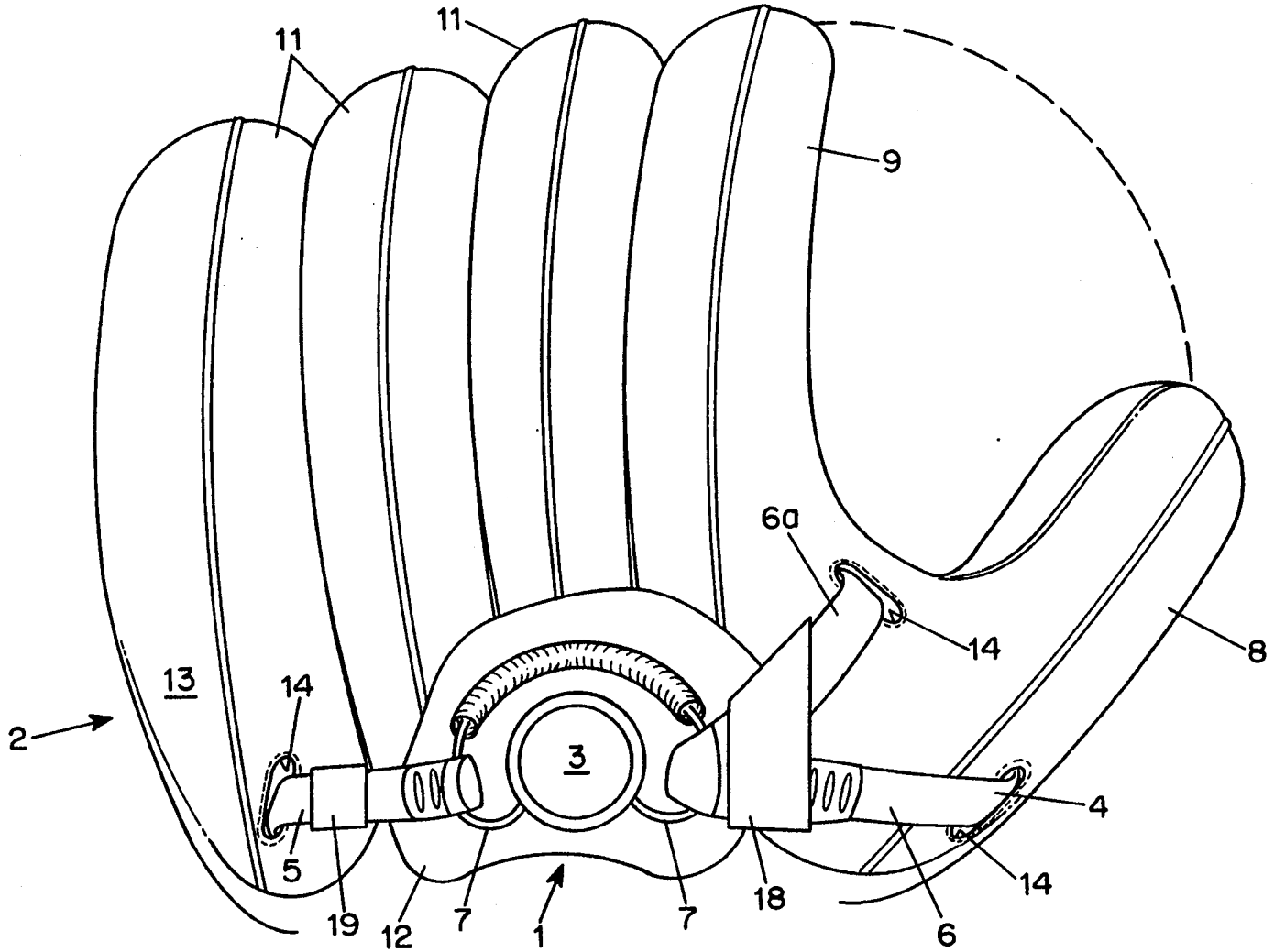
FIG. 7*b* shows the glove of FIG. 7*a* with guide covers attached.
Figure 7C:
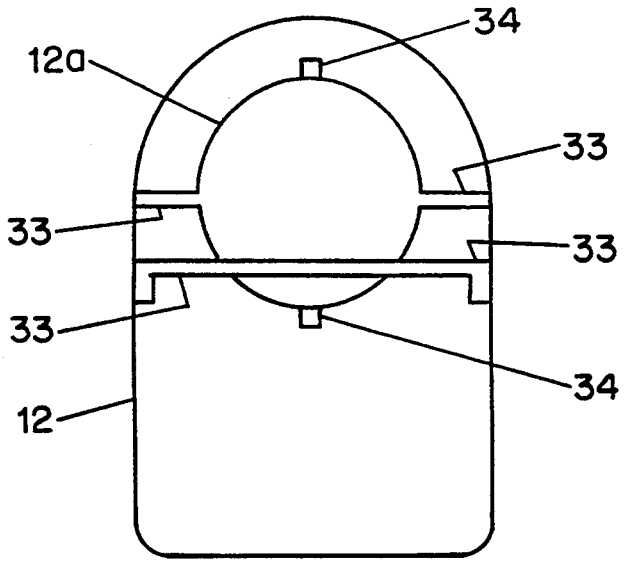
FIG. 7*c* is a top view of a carrier.
Figure 7D:
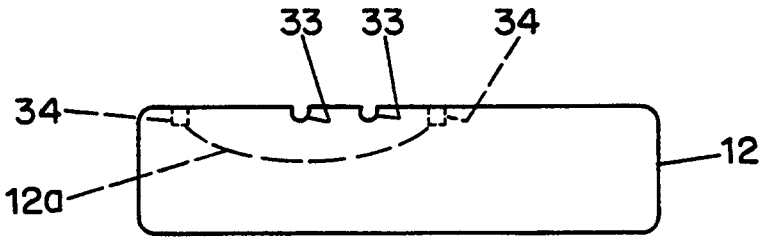
FIG. 7*d* is a side view of a carrier.

In addition to holding the adjusting mechanism 3 in place, the carrier 12 provides the first directional guidance for the adjusting cable 7. The cable 7 extends out of mechanism 3 and through guides 33 as depicted in FIGS. 7*c* and 7*d*. When mechanism 3 is locked into position in carrier 12, cable 7 is dispersed between mechanism 3 and guides 33 directing cable 7 out at the angle dictated by the guides 33. Only two guides 33 are required if the intermediate portions of the cable 7 that are not connected to mechanism 3 run around mechanism 3 rather than under mechanism 3.

The carrier is at least partially constructed of a foam material or other suitably pliable material which will contract around the hand as the effective length of the closed loop in the glove 2 around the hand is reduced as a result of turning the knob of the adjusting mechanism 3. The contraction of the carrier 12 around the hand thereby enhances the fit of the glove 2. Preferably, as depicted in FIG. 7*a*, carrier 12 and mechanism 3 are located on the backside 13, i.e., the side of the glove not designed for catching a ball, although this is not mandatory.

The glove 2 depicted in FIG. 7*a* is of multiple layer construction. In other words there are at least two layers of material (i.e., leather as in a typical baseball glove) in the palm side of the glove 2 and two layers on the backside 13 of the glove 2. Three openings 14 are located on the backside of the glove 2 for receiving the adjusting strips 4 and 4*a*. The ends 5, 6 and 6*a* of strips 4 and 4*a* are attached to the mechanism 3 via the cable 7 and are exposed to the outside of the glove 2 while the rest of the strips 4 and 4*a* are disposed between layers of the backside 13 of the glove 2 or between layers of the palm side of the glove 2.

In this preferred embodiment, the tightening strips 4 and 4*a* are configured as depicted in FIG. 3 wherein the ends of the strips 4 and 4*a* are joined for attachment to the adjusting mechanism 3 via the cable 7. In FIG. 7*b*, the exposed ends 5, 6 and 6*a* of the strips 4 and 4*a* pass through guide covers 18 and 19 fastened to the glove 2 and extending at substantially right angles to the adjusting strips 4 and 4*a*.

Figure 7E:
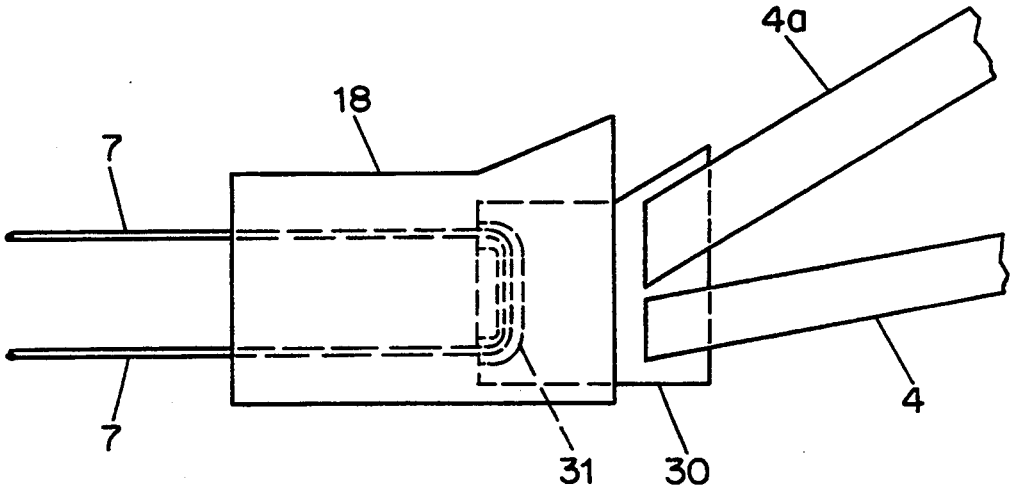
FIG. 7*e* is a top view of the guide cover and the connections underneath.

The guide covers 18 and 19 limit movement of the adjusting strips 4 and 4*b* in undesired directions. Guide cover 18 is shown in more detail in FIG. 7*e*. The adjusting cable element 7 should in some, but not necessarily all cases be guided through guide covers in order to protect the cable 7 and for providing more precise directional guidance.

The ends 5, 6 and 6*a* of the adjusting strips 4 and 4*a* are each provided with connector means 15 which include at least one turning element 16 for guiding and turning the adjusting cable 7.

Figure 8A:
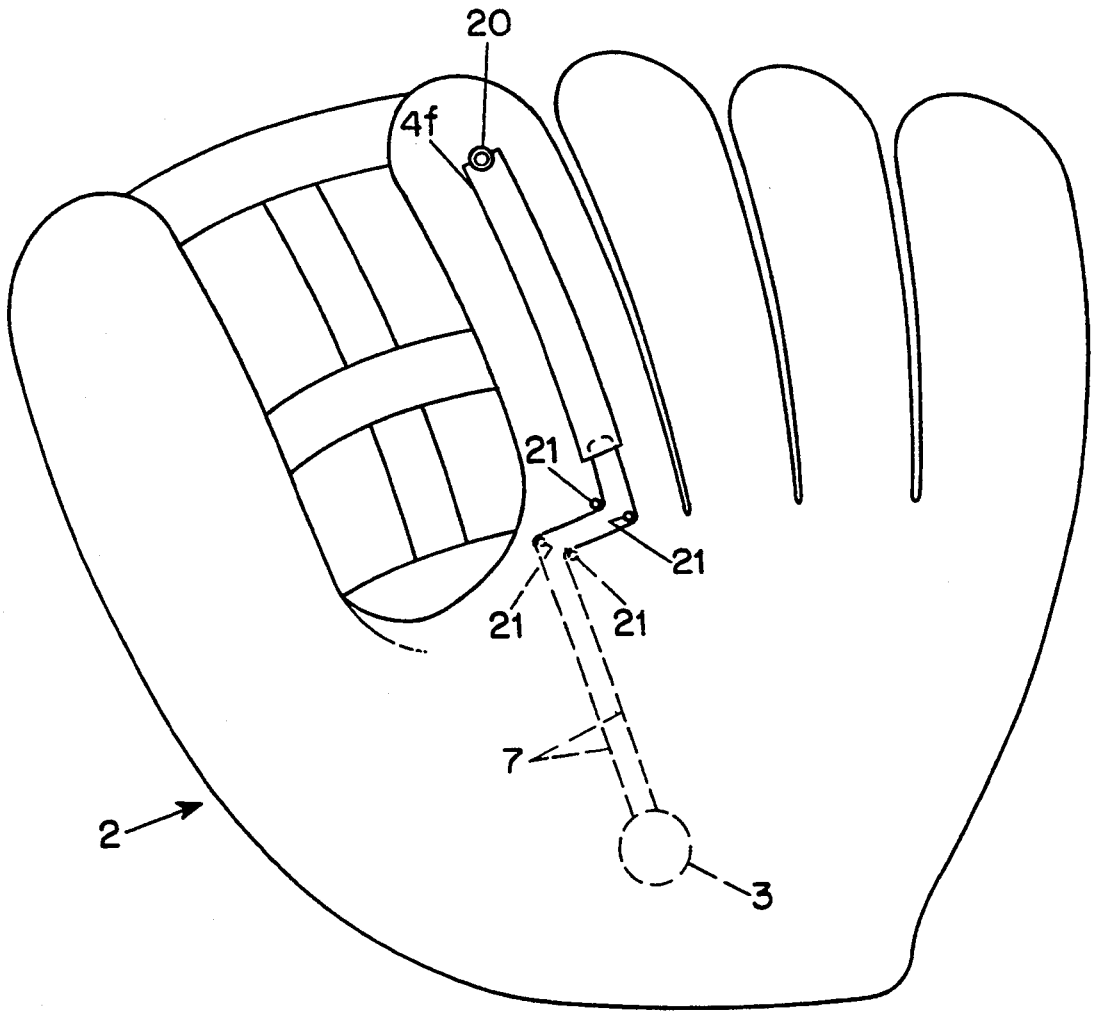
FIG. 8*a* is a cross-sectional view between the palm side layers of the glove.

FIG. 8*a* depicts another preferred embodiment of the invention wherein one end of an adjusting strip 4*f* is anchored to the glove 2 at anchor point 20 rather than forming a closed loop back to the adjusting mechanism 3. FIG. 8*a* is a cross-sectional view between the two layers of the palm side of glove 2 showing the normally internal strip 4*f* and cable 7. The anchoring can be accomplished wherever desired on the glove 2. Anchoring is desirable because adjusting strips on the back of the glove and anchored on either end can tend to cause the glove 2 to fan open which, if excessive, is undesirable since it hinders the retaining of the caught ball. As an example an anchor point 20 is located on the palm side of the glove 2 and thus acts to close the glove 2 when tightened. As a result, the tendency of a glove 2 with a adjusting strip 4 around the base of the glove to fan out is countered by the anchored adjusting strip 4*f*.

Figure 8B:
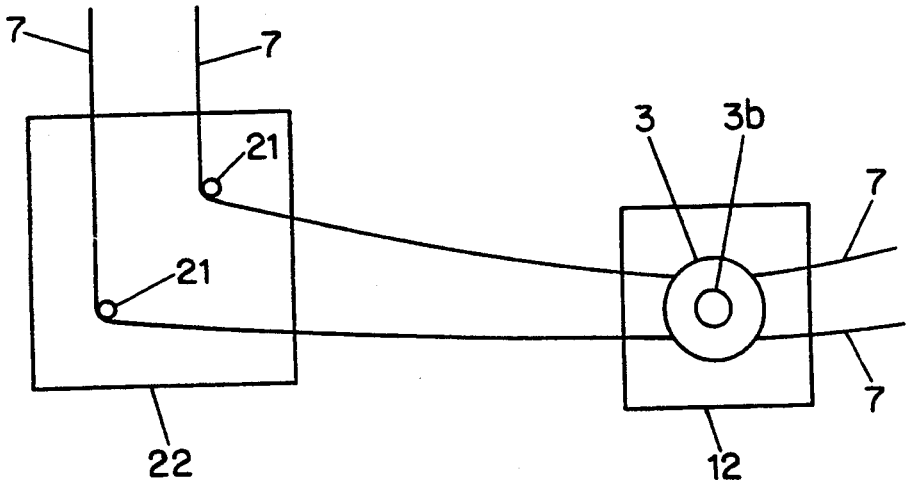
FIG. 8*b* is a top view showing the securing elements.

FIG. 8*a* further illustrates the method for redirecting the cable element 7 such as in this preferred embodiment wherein the desired tightening action is in the palm side of the glove while the adjusting mechanism 3 is on the backside of the glove. FIG. 8*b* shows this aspect of the invention in more detail. Securing elements 21, in this instance pins (but could also be loops or hooks) connected to the glove 2 with the cable element 7 directed along the pins, permit anchored adjusting strip 4*f* to be pulled or released along the line between the anchor point 20 and the securing elements 21. Securing elements 21 can be fastened directly to the glove 2 or, as depicted in FIG. 8*b*, to plate 22 which in turn is fastened to glove 2.

Figure 9:
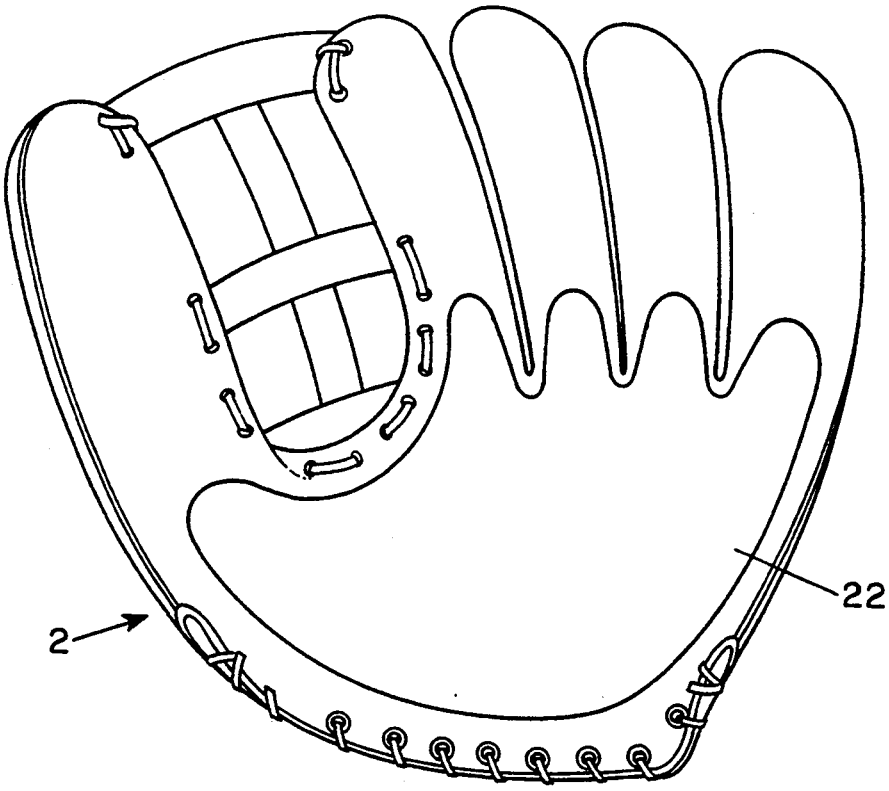
FIG. 9 is a palm side view of the glove with absorbing material.

FIG. 9 depicts a baseball glove having advanced shock absorbing material 22, in this instance Sorbothane®, in the palm of the glove 2. The shock absorbing material 22 exceeds the shock absorption of leather and is lighter than two layers of leather thereby allowing for a decrease in the overall weight of the glove and an increase in shock absorption. Although the usefulness of the shock absorbing material 22 is apparent alone, it is even more useful in combination with the system for adjusting the fit of the glove 2. The tight fit achieved as a result of the glove-tightening systems described above reduces the space between the palm side of the glove and the hand therein. This space can aid or give the feeling of aiding in cushioning the blow as a ball is caught in the glove. The shock absorbing material 22 more than compensates for any lost cushioning effect lost in achieving a tighter fit between palm and glove material. The combination of the tightening system and the absorbing material 22 leads to a glove of reduced weight.

The conventional glove depends on multiple layers of semi-rigid leather padding and leather lanyards in order to form and retain the necessary shape for optimizing catching and retaining a ball. However, as shown above, the use of tighteners, a fit adjusting mechanism, an adjusting cable and adjusting strips can aid in controlling the shape of the glove. Thus, less rigid, thinner and/or lighter materials can be used for the glove while relying on the tightening system to provide structural and forming support. Because the thicker, heavy leather, often in multiple layers has the ancillary effect of providing cushioning of the hand upon impact with the ball, the absorbing material 22 compensates for the loss of inherent cushioning in the pocket area and other areas as required or desired.

Figure 10:
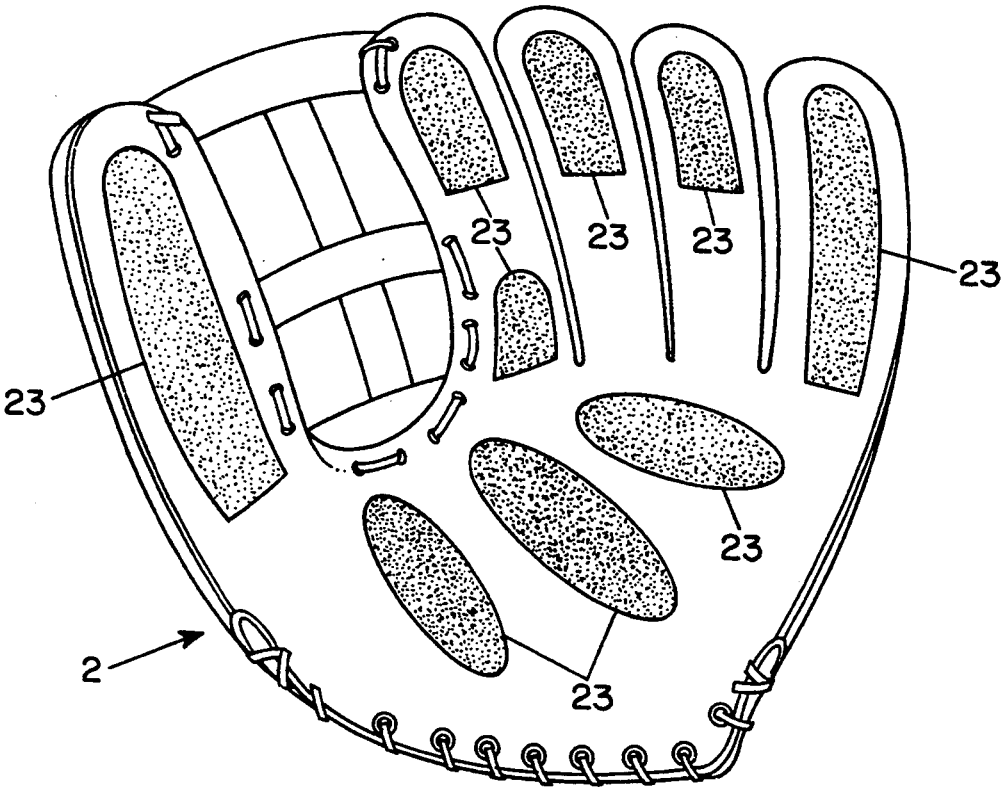
FIG. 10 is a palm side view of the glove with abrasive material.

FIG. 10 depicts a baseball glove with an abrasive type material 23 for enhancing the gripping or catching of the ball in the glove. Synthetic materials such as Lycra and Kevlar or combinations thereof may be used. The abrasive type material 23 in FIG. 10 is applied in patches in the palm of the glove 2 and on the palm side of the finger sleeves 9, 11 and thumb sleeve 8.

While there has been described herein what is believed to be a number of rudimentary and preferred embodiments of the invention, those skilled in the art will recognize that modifications may be made thereto without departing from the spirit of the invention. Such modifications are intended to be within the scope of the present invention.

We claim:

1. A system for improving the fit around a hand inserted in a glove comprising:

a glove having a palm portion, backhand portion and at least one sleeve portion into which one or more finger digits may be inserted;

an adjusting mechanism for controlling the tightening and releasing of the glove around the hand;

at least one adjusting strip extending substantially around a portion of the glove and having a first and a second end; and an adjusting cable element connecting the first and second ends of the adjusting strip to the adjusting mechanism and having an effective length variable by operation of the adjusting mechanism;

wherein the adjusting mechanism, adjusting strip and adjusting cable element substantially form a closed loop around the glove and substantially encircle the hand when inserted therein, having an effective length such that operation of the adjusting mechanism improves the fit of the glove around the hand when operated to shorten the adjusting cable element so as to shorten the effective length of the closed loop and loosens the fit of the glove around the hand when operated to release the adjusting cable element so as to increase the effective length of the closed loop.

2. A system according to claim 1, wherein said adjusting strip is substantially circumferentially disposed at the base of the glove.

3. A system according to claim 1, wherein the glove is constructed of at least one material yielding to tensile stress.

4. A system according to claim 1, wherein in the area of said adjusting mechanism, the glove is constructed with a resiliently flexible material.

5. A system according to claim 1, wherein said adjusting mechanism is disposed on the backside of the glove and proximal to the metacarpal bones of a hand when inserted in the glove.

6. A system according to claim 1, wherein said adjusting mechanism is disposed on one side of the glove proximal to the carpal bones of a hand when inserted in the glove.

7. A system according to claim 1, wherein said at least one adjusting strip is made of a partially elastic material.

8. A system according to claim 1, wherein said adjusting cable element is made of a nylon lace, lanyard or steel wire.

9. A system according to claim 1, wherein said adjusting mechanism comprises a reel, and wherein said adjusting cable element is wound onto and off of the reel by rotation of said adjusting mechanism.

10. A system according to claim 9, wherein said adjusting mechanism further comprises a pawl mechanism and a push-button mechanism, and wherein the pawl mechanism is associated with said reel, which is unlocked by the push-button mechanism for unwinding said adjusting cable element from said reel.

11. A system according to claim 1 wherein said glove incorporates at least one foam type shock absorbing material in the palm area of the glove.

12. A system according to claim 1 incorporating at least one synthetic abrasive material sewn to a leather-type material used to construct the glove in order to provide additional abrasive characteristics for purposes of gripping and catching.

13. A system according to claim 1, wherein said adjusting strip is made of leather.

14. A system according to claim 11, wherein said glove has a plurality of finger sleeves and the shock absorbing material extends at least partially into the finger sleeves of the glove.

15. A system according to claim 1, wherein said adjusting mechanism alters the effective length of the adjusting cable element by means of a rotary motion of the adjusting mechanism.

16. A system according to claim 1, wherein the first and second ends of said adjusting strip are connected to said adjusting cable element.

17. A system according to claim 1, wherein the adjusting mechanism is located at the backhand portion of the glove's base portion.

18. A system according to claim 17, wherein at least one adjusting strip is located substantially around the base portion of said glove.

19. A system according to claim 1, wherein a second adjusting strip extends via said adjusting element from said adjusting mechanism between a thumb sleeve and an index finger sleeve of the glove in the area of the metacarpal bone, substantially in parallel to four directly joining finger joints of the hand in the glove and back to said adjusting mechanism.

20. A system according to claim 1, wherein an additional adjusting strip extends via said adjusting cable element from said adjusting mechanism between the thumb sleeve and the index finger sleeve of the glove, with substantially oblique extension in the area of the metacarpal bones towards the sleeves on the backside of said glove, and back to said adjusting mechanism via the palm side of said glove.

21. A system according to claim 1, wherein at least one additional adjusting strip extends via said adjusting cable element from said adjusting mechanism between the thumb sleeve and the index finger sleeve of the glove, around one of said sleeves and back to said mechanism.

22. A system according to claim 1, wherein at least one additional adjusting strip extends via said cable element from said adjusting mechanism between the thumb sleeve and the index finger sleeve of the glove as well as between two other finger sleeves back to said adjusting mechanism.

23. A system according to claim 1, wherein at least one additional adjusting strip extends via said cable element from said adjusting mechanism between two fingers of the glove, around one or more fingers and back to said adjusting mechanism.

24. A system according to claim 1, wherein the glove has a foamed material in the area of said adjusting mechanism.

25. A system according to claim 24, wherein the adjusting mechanism is affixed to a carrier support element approximately configured to accommodate the shape of said adjusting mechanism, said carrier support element being constructed from foam or other cushioning material.

26. A system according to claim 1, wherein said adjusting strip is located between at least two layers of the glove and wherein its two ends project outwardly through openings in the glove proximal to the adjusting mechanism.

27. A system according to claim 1, wherein the portion of adjusting strip extending on the outside of the glove is passed through guide covers fastened on the glove and extending at substantially right angles to said adjusting strip for guiding the path of said adjusting strip.

28. A system according to claim 1, wherein at least one end of said adjusting strip is provided with a connector means and at least one turning element for guiding and turning said cable element.

29. A system according to claim 28, wherein said turning element has a substantially semicircular configuration such that said cable element extending from said adjusting mechanism is turned towards said mechanism.

30. A system according to claim 28, wherein said turning element is provided with a peripherally extending groove for at least partial accommodation of the respective cable element.

31. A system according to claim 30, wherein holding means are associated with said turning element for additionally fixing the respective cable element received in said groove.

32. A system according to claim 28, wherein said turning element is disposed on at least one of said ends of said adjusting strip, which is passed between two layers of the glove, through openings in the glove so as to prevent self-removal.

33. A system according to claim 28, wherein multiple turning elements are disposed in succession one behind the other for size, shape and tension adjustment of the glove.

34. A system according to claim 28, wherein said turning elements are made of synthetic material.

35. A system according to claim 1 wherein at least one adjusting mechanism is connected to an adjusting cable element which contacts at least one finger sleeve portion of said glove to more closely secure a finger within the glove.

36. A system according to claim 16, further comprising means for redirecting said cable element to a desired portion of said glove.

37. A system according to claim 1, wherein the first end of said adjusting strip is connected to said adjustment cable element and the second end of said adjusting strip is connected to a portion of said glove.

38. A system according to claim 37, further comprising means for redirecting said cable element to a desired portion of said glove.

39. A system according to claim 18, comprising at least two adjusting strips which are joined to each other at least one end for connecting to the adjusting mechanism.

40. A system according to claim 39 wherein the two adjusting strips are located such that the thumb of a hand when inserted into the glove is disposed between the two adjusting strips.

41. A system according to claim 40, wherein the glove comprises two layers and wherein a portion of the adjusting strip is disposed between said two layers.

42. A system according to claim 17, wherein the adjusting cable element connects one end of at least one adjusting strip to the adjusting mechanism and wherein the other end of the adjusting strip is anchored to the glove.

43. A system according to claim 42, wherein the adjusting strip is anchored to the palm portion of the glove.

44. A system according to claim 43, comprising at least two adjusting strips located substantially around the base of said glove.

* * * * *

UNITED STATES PATENT AND TRADEMARK OFFICE

CERTIFICATE OF CORRECTION

PATENT NO. : 5,367,712

DATED : November 29, 1994

INVENTOR(S) : Christopher H. Smith et al.

It is certified that error appears in the above-indentified patent and that said Letters Patent is hereby corrected as shown below:

Title page, item [75], "Verda" should be --Vedra--; item [56], second column, third patent under "FOREIGN PATENT DOCUMENTS," "3/1893" should be --3/1895--; item [57], ABSTRACT, line 8, after "shortened" insert --to--; Column 2, line 6, "provide" should be --provides--; Column 2, line 15, after "be" delete "a"; Column 10, line 43, before "at" insert --at--.

Signed and Sealed this

Eighth Day of August, 1995

*Attest:*

Bruce Lehman

BRUCE LEHMAN

*Attesting Officer*

*Commissioner of Patents and Trademarks*